US006370779B1

(12) United States Patent
Pappas

(10) Patent No.: US 6,370,779 B1
(45) Date of Patent: Apr. 16, 2002

(54) WICK TRIMMER

(75) Inventor: George G. Pappas, Norwich, OH (US)

(73) Assignee: Lumi-Lite Candle Company, Inc., Norwich, OH (US)

( * ) Notice: Subject to any disclaimer, the term of this patent is extended or adjusted under 35 U.S.C. 154(b) by 0 days.

(21) Appl. No.: 09/550,185

(22) Filed: Apr. 14, 2000

Related U.S. Application Data

(63) Continuation of application No. 09/038,229, filed on Mar. 11, 1998, now Pat. No. 6,076,262.

(51) Int. Cl.[7] ..... B26B 13/00; B26B 13/22
(52) U.S. Cl. ..... 30/179; 7/163; 30/233
(58) Field of Search ..... 30/233, 179, 28; 7/163

(56) References Cited

U.S. PATENT DOCUMENTS

| | | | |
|---|---|---|---|
| 18,713 | A | 11/1857 | Stow et al. |
| 36,590 | A | 9/1862 | Eagle |
| 80,577 | A | 8/1868 | Warner |
| 97,776 | A | 12/1869 | Jenkins, Jr. |
| 169,091 | A | 10/1875 | DeZeng |
| 169,785 | A | 11/1875 | DeZeng |
| 211,209 | A | 1/1879 | Andrews |
| 223,027 | A | 12/1879 | Blanchard |
| 356,319 | A | 1/1887 | Jordan |
| 452,289 | A | 5/1891 | Scott |
| 600,650 | A | 3/1898 | Powell |
| 622,510 | A | 4/1899 | Morneau |
| 920,822 | A | 5/1909 | Buckman |
| 2,835,032 | A | 5/1958 | Dorazio, Jr. |
| 4,776,096 | A | 10/1988 | Chang |
| 5,035,054 | A | 7/1991 | Ellenberger |

FOREIGN PATENT DOCUMENTS

| | | |
|---|---|---|
| FR | 2380850 | 10/1978 |

*Primary Examiner*—Douglas D. Watts
(74) *Attorney, Agent, or Firm*—Frank H. Foster; Kremblas, Foster, Philips & Pollick

(57) ABSTRACT

A wick trimmer includes a gauge for assisting a user in trimming a candle wick to an appropriate length. The wick trimmer is adapted to be of a shape and size to allow a user to trim the wick within a votive holder, hurricane lamp, or the like without removing the candle. The gauge may be fixedly, rotatably, or slidably attached to the cutter and extends transversely of the blade of the cutter.

1 Claim, 3 Drawing Sheets

WICK TRIMMER

CROSS REFERENCE TO RELATED APPLICATIONS

This application is a continuation of application Ser. No. 09/038,229, filed Mar. 11, 1998, now U.S. Pat. No. 6,076,262.

BACKGROUND OF THE INVENTION

1. Field of the Invention

This invention relates generally to a candle wick trimmer, and more particularly to a wick trimmer adapted to gauge the length of a wick prior to cutting.

2. Description of the Related Art

Various devices for trimming wicks have been invented since the advent of the candle making industry. New candles are often sold with wicks which are longer than they should be for optimum safety. Additionally, from time to time as a result of burning, a candle wick may become too long or an excessively long burnt carbonized portion may remain attached to the protruding wick. A failure to trim a new wick and to subsequently trim wicks after use can create a fire hazard. Therefore it is desirable to keep the wicks of candles at an appropriate length.

It is desirable to trim a wick so that it is neither too long nor trimmed too close to the wax. If a wick is too short, the wax surrounding the wick will melt and may extinguish the flame. If the wick of a pillar candle is permitted to become too long, the flame will enlarge and generate more heat which can be a fire hazard to any nearby combustible objects. Because some pillar candles burn away a central portion of wax but leave tall sidewalls, the excess heat can melt a hole through the wax sidewall causing a sudden runoff of the molten wax pool. This runoff permits the wick to suddenly protrude even farther above the remaining wax pool and thereby produce an even hotter flame which can be a hazard to any nearby combustible materials.

A further problem with an excessively long wick occurs because the end of a long wick will not receive molten wax and therefore the wick itself burns. These carbonized wick pieces if on a taper candle can drop off onto the surface on which the candle rests and cause burn marks or a fire. With a container candle the carbonized pieces can drop into the molten wax within the candle, creating a hazardous secondary wick. When the candle burns near the bottom, the secondary wicks can eventually cause an explosion because the extra heat raises the wax temperature to cause an abundance of combustible wax vapors.

Trimming a candle wick removes any excess existing carbonized or unburnt wick and decreases the likelihood that the wick will become too long or form an excessive carbonized portion during its next burning interval.

A number of wick trimmers have been developed over the years. Many focus on the problem of easily collecting the waste wick which the trimmer removes. These include U.S. Pat. Nos. 18,713; 36,590; 169,091; 169,785; 223,027; and 356,319. Other wick trimmers have focused on the shape of the wick after cutting. These include U.S. Pat. Nos. 211,209; 622,510; and 920,822. The patent to Scott, U.S. Pat. No. 452,289 focuses on cleaning the trimmer cutting surfaces rather than on the trimming itself.

Some patents have, however, focused to a certain extent on determining the length of a wick. The patent to Warner, U.S. Pat. No. 80,577 discloses a tube which slides over the wick tube of a lamp whose wick needs to be cut. However, the purpose of the Warner wick trimmer is to protect the wick tube, rather than to determine the length of the wick. The patent to Jenkins, U.S. Pat. No. 97,776 discloses a similar type of invention for use with a lamp and wick tube, but which is designed to be permanently mounted to the lamp. None of these devices mentioned above incorporates a gauge which determines the length of a wick to be cut.

The patent to Dorazio, U.S. Pat. No. 2,835,032 discloses a tool for cutting electronic circuit components to equal lengths. In Dorazio, a bracket is employed as a stop mechanism through which a strand would pass to the cutting implement. The bracket is adjustable. However, the size and shape of the cutter disclosed in Dorazio would not be suitable for trimming a candle wick especially if the wick is down inside a surrounding object, such as a container wall or wax sidewalls left on a pillar candle.

Another problem is that many candles are not used in locations where they are exposed on all sides. The use of candles with a "hurricane" cover has become quite popular over the past several years. In addition many people use shorter candles, such as votives, in shielded containers accessible only from the top. It is therefore desirable to have a wick trimmer which can fit inside the container to reach the candle already in place rather than removing the candle to cut the wick. The prior patents and current market do not have any wick trimmers which would be acceptable for such uses.

SUMMARY OF THE INVENTION

The present invention relates to a wick trimmer having a gauge finger which in operative position will extend transversely from the blade or blades of the wick trimmer. The gauge finger is adapted to rest on the fuel portion or top surface of the wax of a candle and gauge the length of a wick. The wick trimmer may be used in any number of applications but will assist a user in cutting wicks to the same length. This not only reduces the safety hazards described above but also creates a more aesthetically pleasing appearance to a set of candles or to a multiwick candle. A more aesthetically pleasing appearance and uniform burning rates are possible since the gauge finger will cause all wicks to be the same length. The use of the wick trimmer will also assist in removing any excess wick without cutting the wick so short that a user is unable to light the candle. The wick trimmer is also designed so that it may be operated while inserted down into a container holding a candle or into a pillar candle with unburned sidewalls. The preferred wick trimmer is not only able to cut such a surrounded wick but also can lift the severed portion out of the surrounding walls.

The gauge finger may be attached to the cutter in any number of ways. The most preferable ways are either permanently affixed, rotatably attached, or slidably attached. The cutter may be either a blade engaging an anvil or a first blade engaging a second blade. There may be arms attached to the cutter for stability or for actuation of the cutter. The actuator may also serve to rotate the gauge finger.

The specially adapted wick trimmer will serve to enable a person more easily and more accurately to trim a wick of a candle.

Figure 1:
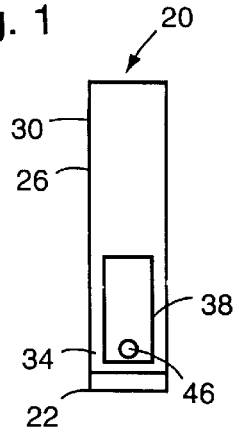
FIG. 1 is a back view of the invention with the gauge finger in retracted position.
Figure 2:
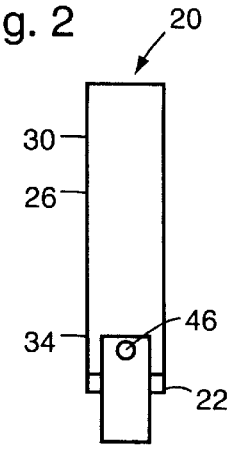
FIG. 2 is a back view of the invention with the gauge finger in operative position.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

Turning first to FIGS. 1–10, a wick trimmer is shown generally at 20. This wick trimmer has a similarity to the commonly-used nail clipper.

Wick trimmer 20 has two blades 22,24 which comprise the cutter. The cutter is attached to arms 26 and 28. Arms 26 and 28 are attached at their top ends 30 and 32 to form a pivot. Top ends 30 and 32 may be joined in any of the conventional ways for joining materials together. The preferred material for blades 22,24 and arms 26 and 28 is metal, most preferably stainless steel. The preferred method for joining top ends 30,32 of arms 26,28 is by a spot weld. Other types of metal fasteners are also possible.

Arms 26,28 are joined to blades 22,24, respectively, at the bottom ends 34,36 of arms 26,28. Arms 26,28 are formed integrally with blades 22,24, respectively. There is no particular boundary where the arm ends and the cutter begins since they are integrally joined. Therefore an element which is described as being attached to or near the cutter may be attached in a variety of locations including, but not limited to, the bottom ends 34,36 of arms 26,28.

Figure 10:
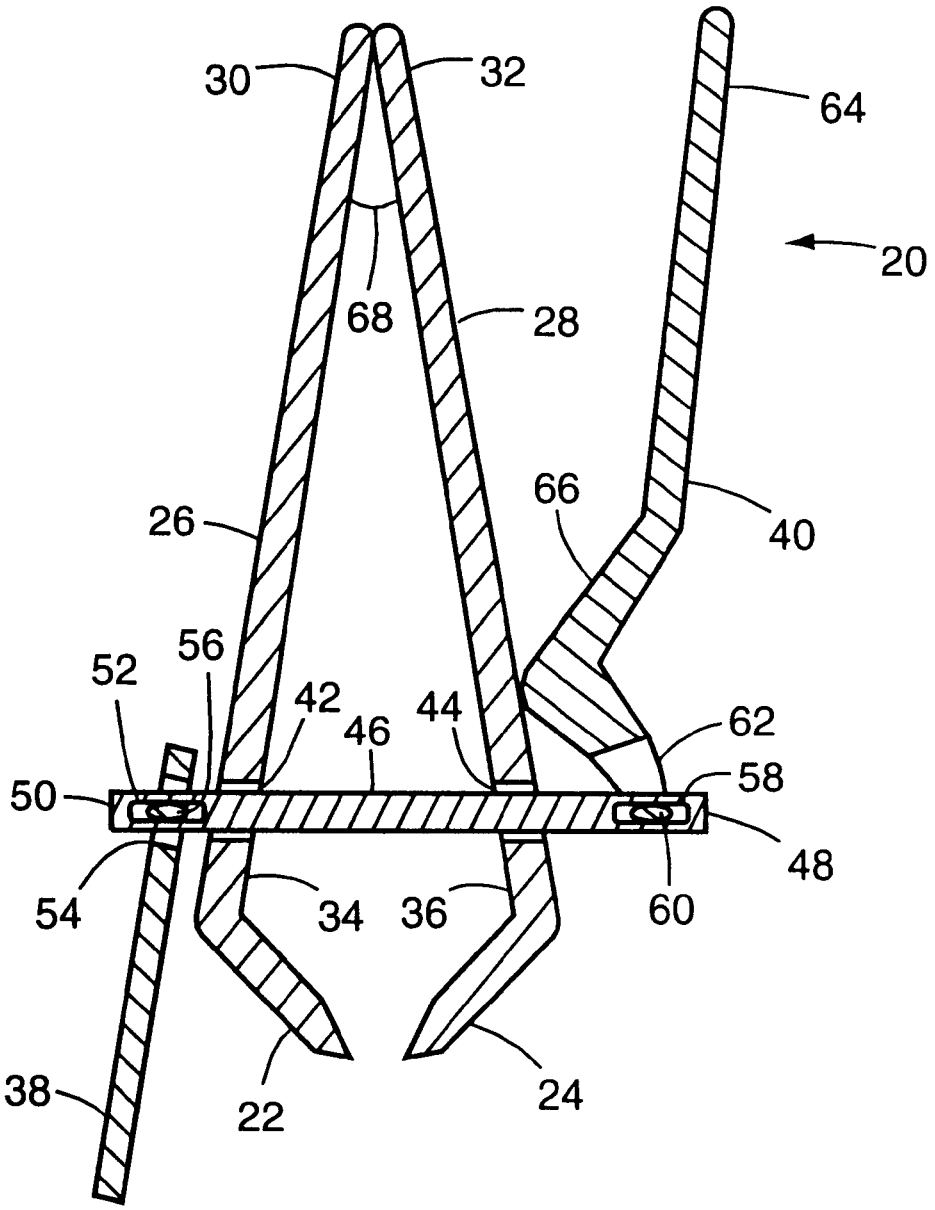
FIG. 10 is a sectional view of the wick trimmer according to the invention taken along line 10—10 of FIG. 6.

Wick trimmer 20 also includes a gauge finger 38 and an actuator 40. FIG. 10 most clearly shows the structural features of wick trimmer 20. Arms 26,28 include apertures 42,44 which are preferably aligned. A rod 46 passes completely through apertures 42 and 44 and has an actuator end 48 and also an opposite gauge finger end 50.

The actuator end 48 of rod 46 has a transverse actuator end hole 58. Actuator 40 is rotatably secured to rod 46 via actuator attachment finger 60. Finger 60 is an integral part of actuator 40 and extends through actuator end hole 58. Actuator 40 and its finger 60 surround a flip recess 62. Finger 60 may alternatively be a pair of fingers, one extending inwardly from each side of actuator 40, each finger extending partially through end hole 58. Actuator 40 is rotatable with respect to arms 26,28 and blades 22,24.

Gauge finger end 50 of rod 46 has a transverse gauge finger hole 52. Gauge finger 38 includes gauge finger aperture 54 and gauge finger extension 56 which is an integral part of gauge finger 38 and extends through gauge finger hole 52. This system for attaching gauge finger 38 to rod 46 is substantially identical to the attachment of actuator 40 to the opposite end of rod 46. However, gauge finger aperture 54 is not big enough to allow gauge finger 38 to flip over rod 46, as is actuator 40 (as described below). Instead of including gauge finger hole 52, gauge finger aperture 54, and gauge finger extension 56 may be formed integrally to secure gauge finger 38 to rod 46, rod 46 and gauge finger 38. The attachment of gauge finger 38 to rod 46 permits gauge finger 38 to be rotated by rotation of rod 46. Gauge finger 38 is thus rotatable with respect to arms 26,28 and blades 22,24 and, in its operable position, extends from the cutter transversely of the blades 22,24.

Figure 3:
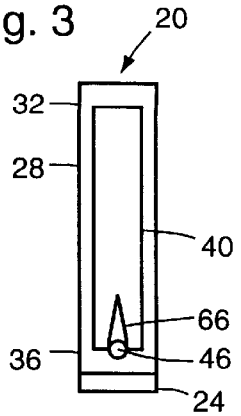
FIG. 3 is a front view of the invention with the actuator in retracted position.
Figure 4:
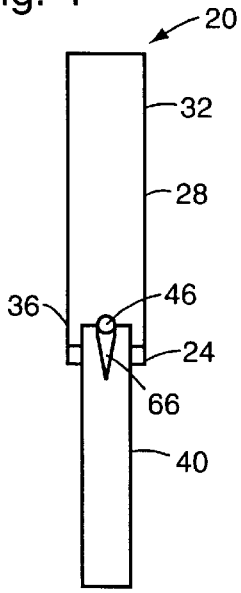
FIG. 4 is a front view of the invention with the actuator in flipped position.
Figure 5:
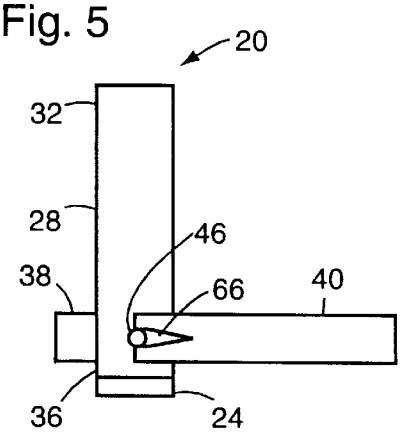
FIG. 5 is a front view of the invention with the actuator and the gauge finger in partially rotated position.
Figure 7:
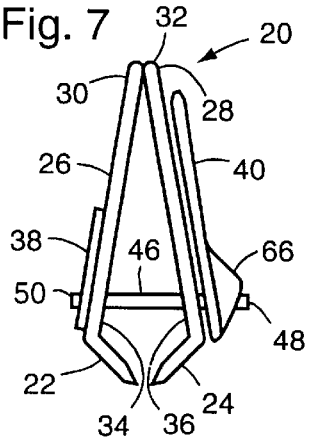
FIG. 7 is a side view of the invention with the gauge finger and actuator in retracted position.
Figure 8:
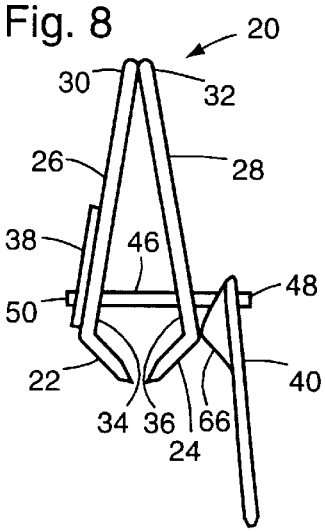
FIG. 8 is a side view of the invention with the actuator in flipped position and the gauge finger in retracted position.
Figure 9:
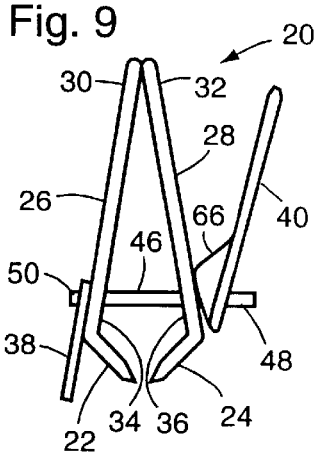
FIG. 9 is a side view of the invention with the actuator and the gauge finger in operative position.

Since both gauge finger 38 and actuator 40 are attached to rod 46, rotation of actuator 40 will cause the rotation of both rod 46 and gauge finger 38. This rotation shows the ease of use of the present invention. The rotation is shown most clearly in FIGS. 1–9. FIGS. 1, 3, and 7 show the gauge finger 38 and actuator 40 in retracted position. The retracted position is the most compact position and is often used for ease of storage. FIGS. 4 and 8 show gauge finger 38 in retracted position and actuator 40 in flipped position. In order to allow actuator 40 to flip over rod 46, actuator 40 is provided with flip recess 62, most clearly shown in FIG. 10, which should be of a size and shape sufficiently large to allow actuator 40 to flip around actuator attachment finger 60 from the retracted position shown in FIG. 7 to the flipped position shown in FIG. 8. The term "flip" refers to a rotation of actuator 40 over rod 46 about the axis of finger 60. The "flipping" motion does not cause a rotation of rod 46. After flipping the actuator from the position of FIGS. 3 and 7 to the position of FIGS. 4 and 8, a user may then grasp actuator 40 and rotate it in order to also rotate rod 46. Rod 46 may be rotated either clockwise or counterclockwise. As best seen in FIG. 5, if a user rotates actuator 40, thereby rotating rod 46, gauge finger 38 will also be rotated in the same direction (clockwise or counterclockwise). The rotation of actuator 40 will therefore rotate gauge finger 38. As seen in FIGS. 2, 6, 9, and 10, once the rotation of 180 degrees is completed, the actuator 40 will be in its operative position and the gauge finger 38 will be in its operative position extending from the cutter transversely of the blades 22,24.

Wick trimmer 20 is then placed near a candle. Gauge finger 38 is placed by the user on the fuel portion of the candle (not shown) and a wick (not shown) will pass between blades 22 and 24. The gauge finger 38 will thereby maintain the distance between the top of the wax and blades 22 and 24. A user will then press the top end 64 of actuator 40 towards the top ends 30,32 of arms 26,28. Actuator 40 also includes a protruding knob 66 which serves as a fulcrum so that actuator 40 functions as a lever. Pressing top end 64 of actuator 40 towards top ends 30,32 of arms 26,28 will cause a force to be applied on arm 28 by knob 66. The force of knob 66 against arm 28 will serve to move arm 28 closer to arm 26 most particularly by decreasing the size of angle 68. In this way blades 22,24 will be brought closer together on either side of a wick and will sever the wick at the appropriate length. It will be apparent to one of ordinary skill in the art that the materials used in wick trimmer 20 should be such that they are efficiently deformable as to allow a certain range of bending deformation to allow blades 22,24 to sever a wick but not sufficiently deformable that the force applied to actuator 40 or to arm 28 via knob 66 will permanently deform the wick trimmer 20.

The preferred length of a candle wick is in the range of about one eighth to one quarter inch, the longer length being more appropriate for larger candles. Consequently, the gauge finger preferably has a length so that the distance from the end of the gauge finger to the cutter is about in that range.

Once the wick has been cut by the pressing of blades 22 and 24 together by actuator 40, the actuator 40 may be held in place while the user retracts the wick trimmer 20 from a position near the candle. The holding of actuator 40 in pressed position will serve to keep the excess wick, which was trimmed, on top of blades 22 and 24 between arms 26 and 28 to be disposed of elsewhere after the actuator 40 is released. Once a user has completed his or her trimming of candle wicks, the reverse of the rotation and flipping process disclosed above may be used to return gauge finger 38 and actuator 40 to their retracted positions.

Figure 11:
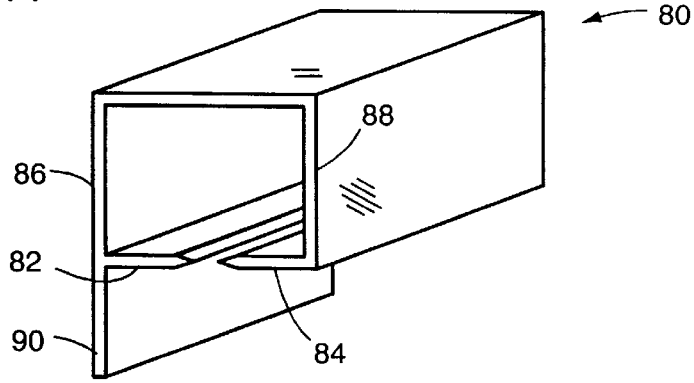
FIG. 11 is a perspective view of a first alternative embodiment of a wick trimmer according to the invention.

Turning now to FIG. 11, a first alternative embodiment of the wick trimmer is shown. The embodiment shown in FIG. 11 is a very simple version of the wick trimmer as shown in FIGS. 1–10. This wick trimmer 80 also includes blades 82 and 84 attached to arms 86 and 88. Arms 86 and 88 are joined together by a web to form essentially three sides of a rectangular tube. Because of the way in which this first alternative embodiment is designed, for ease of production it is preferable to extrude the entirety of the product in one step. Thus it is again somewhat indefinite where blades 82,84 end and arms 86,88 begin. This embodiment also includes a gauge finger 90. Gauge finger 90 may extend the entire width of the trimmer as shown or it may simply extend a portion of the width. It is desirable not to make wick trimmer 80 too wide as it will be unable to fit inside a small container which houses, for example, a votive candle. The wick trimmer 80 must be wide enough to be wider than the wick and should be at least as wide as a human finger, so as to enable easy grasping; it must also be wide enough to be structurally durable. However, it should not be wider than the standard votive holder, which can be just wider than the votive candle, i.e., about 1½ inches. Because it is desirable to fabricate the entirety of this first alternative embodiment of the wick trimmer invention out of one piece of material it will be apparent to one of ordinary skill in the art that gauge finger 90 is also formed with the remainder of the wick trimmer as and integral part and thus it is permanently affixed near the cutter in a stationary position.

Figure 12:
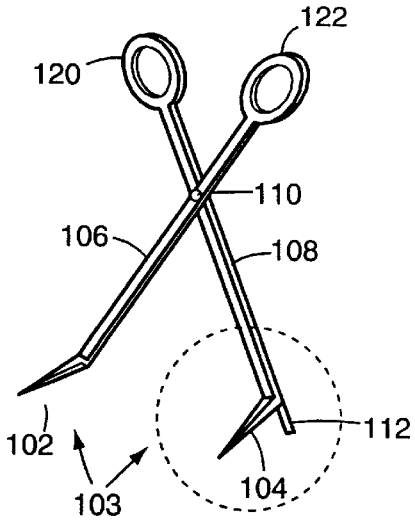
FIG. 12 is a perspective view of a second alternative embodiment of the wick trimmer according to the invention.

Turning now to FIG. 12, a second alternative embodiment of the wick trimmer according to the invention is shown. This wick trimmer 100 also includes blades 102 and 104, arms 106 and 108, a pivot 110 which secures arm 106 to arm 108 in a rotatable manner. This embodiment also includes gauge finger 112.

Figure 17:
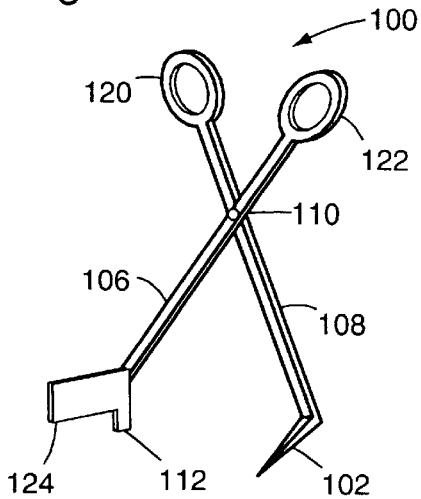
FIG. 17 is a perspective view of a wick trimmer according to the alternative embodiment of FIG. 12 showing the use of a blade and anvil instead of two blades.

As shown in FIG. 17, the wick trimmer may include a blade 102 which seats against an anvil 124 rather than two blades 102,104. While gauge finger 112 is shown in FIG. 17 as being attached to anvil 124 it may instead be attached to blade 102 as illustrated in FIG. 12.

Figure 6:
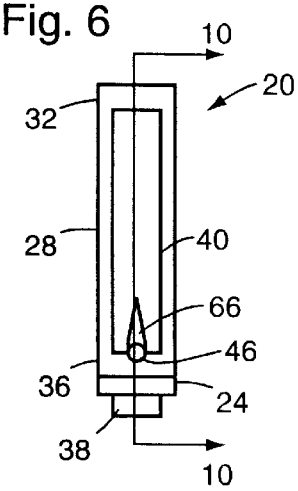
FIG. 6 is a front view of the invention with the actuator and gauge finger in operative position.
Figure 13:
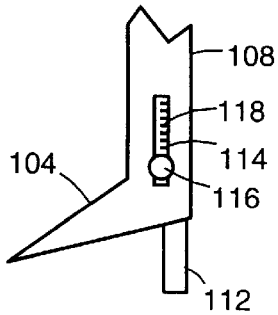
FIG. 13 is a close-up view of a blade and gauge finger of the embodiment as shown in FIG. 12 showing the gauge finger in operative position.
Figure 14:
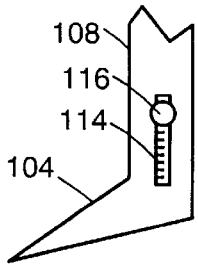
FIG. 14 is a close-up view of a blade and gauge finger according to FIG. 12 with the gauge finger shown in retracted position.

FIGS. 13–6 show a blow-up of the area shown in dashes on FIG. 12 and represent two alternative methods of attaching a gauge finger to this embodiment. As in the previous embodiments, because each piece, for example blade 102 and arm 106, is molded integrally, exactly where blade 102 ends and arm 106 begins is indefinite and immaterial. As shown in FIG. 13, blade 104 is attached to arm 108 and a gauge finger 112 extends transversely from the cutter or blade 104. On the cutter 103 is an elongated sliding aperture 114. Sliding aperture 114 is included so that slide 116 may move freely upwards and downwards in sliding aperture 114. The slide 116 may be manually moved to actuate gauge finger 112 and move it in a sliding fashion from the operable position as shown in FIG. 13 to the retracted position shown in FIG. 14 and in the reverse direction. Any of the standard methods for using a slidably attached mechanism may be used as illustrated. A spring mechanism 118 assists in both locking the gauge finger in operative position and in the motion of slide 116. However, anyone of ordinary skill in the art will recognize that various substitutions may be made with the same result being achieved.

Figure 15:
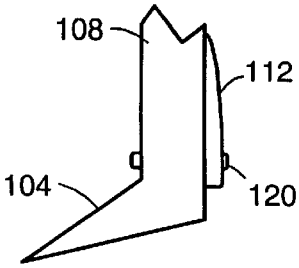
FIG. 15 is a close-up view of a blade and an alternative embodiment of a gauge finger in retracted position in accordance with the alternative embodiment of FIG. 12.
Figure 16:
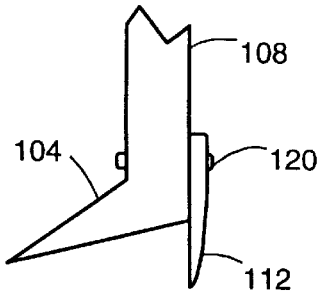
FIG. 16 is a close-up view of a blade and an alternative embodiment of a gauge finger in operative position according to the alternative embodiment of FIG. 12.

FIGS. 15 and 16 similarly show a gauge finger which is rotatably attached to the cutter 108. FIG. 15 shows the gauge finger in retracted position and FIG. 16 shows the gauge finger in operative position. The gauge finger 112 is rotatably attached to wick trimmer 100. In this drawing a bolt 120 is shown as extending outwardly from the cutter to secure gauge finger 112 to the cutter but still allow for rotation. It will be appreciated by one of ordinary skill in the art that alternative methods of installing a rotatable finger are equally applicable in this situation and are within the scope of the invention. In addition, the gauge finger may be permanently affixed to the cutter as in any of the other embodiments.

The first alternative embodiment 80, as shown in FIG. 11, and the second alternative embodiment 100, as shown in FIGS. 12–17, function in much the same way as the first embodiment wick trimmer 20. The gauge finger 90 or 112 will rest on the wax surface of a candle and the wick of the candle will pass between blades 82,84 or 102,104. The user will then actuate the wick trimmer in an appropriate manner in order to bring the blades close to each other and thereby sever the wick. In the first alternative embodiment of FIG. 11 this is accomplished by pressing arm 86 and arm 88 close together near blades 82,84. In the second alternative embodiment 100 of FIGS. 12–17 this is accomplished by pressing top ends 120,122 together to act on pivot 110 to bring blades 102 and 104 close together to sever the wick.

Any type of mechanism which is capable of cutting wicks may be used in the context of the invention. Embodiments showing two blades which sever by directly opposed pressure and two blades which sever using a scissor-like action are presented. Any of these embodiments can easily be adapted to have the other type of two blade structures. In addition, a blade and anvil may also be used as an alternative.

While certain preferred embodiments of the present invention have been disclosed in detail, it is to be understood that various modifications may be adopted without departing from the spirit of the invention or scope of the following claims.

What is claimed is:

1. A method for trimming a candle wick to a selected length of protrusion above candle fuel surrounding the wick, the method comprising:

(a) manually grasping a trimmer having pivotally connected arms, a cutter having at least one blade attached to and oriented transversely of one of the arms and a gauge finger attached to an arm and extending transversely of and beyond the blade by said selected length;

(b) positioning the trimmer with the cutter operably and transversely engaging the wick and the gauge finger contacting the candle fuel; and (c) actuating the cutter by pivoting the arms to trim the wick.

* * * * *